United States Patent [19]

Homsy

[11] Patent Number: 4,955,367

[45] Date of Patent: Sep. 11, 1990

[54] CAM-OPERATED OSCILLATOR SYSTEM FOR THE MANDIBLE

[75] Inventor: Charles A. Homsy, Houston, Tex.

[73] Assignee: Dynamax, Ltd., Tortola, British Virgin Isls.

[21] Appl. No.: 299,197

[22] Filed: Jan. 19, 1989

[51] Int. Cl.[5] ..... A61H 1/02

[52] U.S. Cl. ..... 128/25 R; 433/215; 272/95

[58] Field of Search ..... 433/25, 229, 5, 6, 215, 433/69; 272/94, 95; 128/777, 25 R, 48, 49, 50

[56] References Cited

U.S. PATENT DOCUMENTS 4,292,026 9/1981 Yokota ..... 433/69

4,700,695 10/1987 Davis et al. ..... 272/95

*Primary Examiner*—Cary E. Stone

*Attorney, Agent, or Firm*—Michael P. Breston

[57] ABSTRACT

The mandible oscillator system comprises an intraoral-extraoral appliance mounted on the upper and lower arches of the user. Extraoral oscillating means are coupled to the extraoral portion of the appliance for forcibly oscillating the lower jaw within a predetermined angular range between a starting position and an end position. During one-half cycle of oscillation, the lower jaw is forced to move away from the upper jaw, and during the other half-cycle, the lower jaw is forced to move toward the upper jaw.

4 Claims, 1 Drawing Sheet

CAM-OPERATED OSCILLATOR SYSTEM FOR THE MANDIBLE

FIELD OF THE INVENTION

This invention relates to an involuntary mandible oscillator system which forcibly opens and closes the lower jaw of the user for the purpose of rehabilitating abnormalities in and around the structure of the oral cavity, such as exists, for example following arthroscopic procedures or reconstructive surgery of the temporomandibular joint, commonly known as "TMJ".

BACKGROUND OF THE INVENTION

The lower jaw is made of just one bone, known as the mandible. Jaw closure is the result of contraction of a group of muscles which do not contract singly. They all perform their functions synergistically. The smooth and coordinated function of these muscles is essential for the proper occlusion of the teeth. The mandibular elevators, which close the lower jaw, include the coordinated function of the masseter, temporal, and medial pterygoid muscles. The mandibular depressors which open the lower jaw include the activity of the external pterygoid and the suprahyoid muscles. Protrusion of the mandible is performed by the masseter, internal pterygoid, and the external pterygoid muscles. Retrusion of the mandible is accomplished by the temporal and digastic muscles Mandibular jaw closure depends on functional integrity of a group of muscles which perform their functions simultaneously. The smooth function of these muscles is essential for the proper occlusion of the teeth.

When these muscles and surrounding tissues are impaired due to injury or surgery, disclusion or malocclusion of the teeth often takes place.

When a tensile strain history is imposed on tissue, its physical properties will be changed and/or enhanced dependent on the applied strain and its direction. Tissue will change or remodel its volume, length and mass from a reference structure to a new structure, given a specific strain history imposed on that tissue. Thus, strain can be directed and manipulated so as to accomplish desired and beneficial tissue changes.

Repetitive and rhythmic opening and closing of the mandible, if properly administered, can induce strains within the oral tissue and surrounding structures, which result in enhanced healing and rapid pain reduction or suppression, thereby facilitating and accelerating the complete healing and rehabilitation of the tissue structures of the oral cavity to the point that healed structure can properly and adequately perform its specific function, and can contribute to the overall function of the oral cavity as well as of the total temporomandibular joint.

Rehabilitation of the structures of the oral cavity and of the TMJ (the actual muscle training and tissue healing) can be viewed as being voluntary, semi-voluntary and involuntary.

In U.S. Pat. No. 4,700,695 is described a semi-voluntary, cam-operated jaw-opening system including an intraoral cam arrangement for periodically opening (but not closing) the lower jaw. This arrangement relies upon the user's mandibular elevator muscles to return the jaw. But, frequently and for well-known reasons, a patient's elevator muscles may be under anesthetic agents, or they may be suffering from a disease, or they may have become detached during surgery As such, they may be under too much pain and swelling and incapable of closing the jaw. Normally it may take at least a few weeks before these muscles will reattach to the mandible and start properly functioning again.

This patented semi-voluntary cam arrangement requires two intraoral cams, two maxillary tooth-engaging plates, two mandibular tooth-engaging plates, cam riding grooves within the mandibular plates, and a pair of motor driven cables for reciprocating both cams intraorally.

These intraoral cams require critical positioning and aligning within their assigned grooves, and the slack in the cables may also have to be adjusted.

Some patients may require an attendant to make such adjustments so that all these parts will perform their functions simultaneously and in synchronism as intended in order to achieve proper bilateral jaw opening.

It is an object of this invention to provide an involuntary extraoral cam-operated jaw oscillator system, which can be quickly and easily attached to the maxillary and mandibular arches.

SUMMARY OF THE INVENTION

The extraoral, completely involuntary cam-operated jaw oscillator system includes a maxillary tooth-engaging means, a mandibular tooth-engaging means, and a cam arrangement for periodically opening and closing the lower jaw.

Each tooth-engaging means is a splint having an arch attachable to the jaw or the teeth, and an extraoral extension arm. When the cam rotates it pushes the lower jaw down relative to the upper jaw and then returns the lower jaw to its mouth closed position.

The cam arrangement operates between an upper extraoral bracket and a lower extraoral bracket. The cam is being pivoted by a motor-driven shaft about an axle in one or the other bracket and in so doing exerts a down force on the lower bracket during one half-cycle of oscillation. A pivot rides in a groove in the cam which forces the cam to forcefully lift the lower bracket and the lower jaw during the other half-cycle.

DESCRIPTION OF PREFERRED EMBODIMENTS

Figure 1:
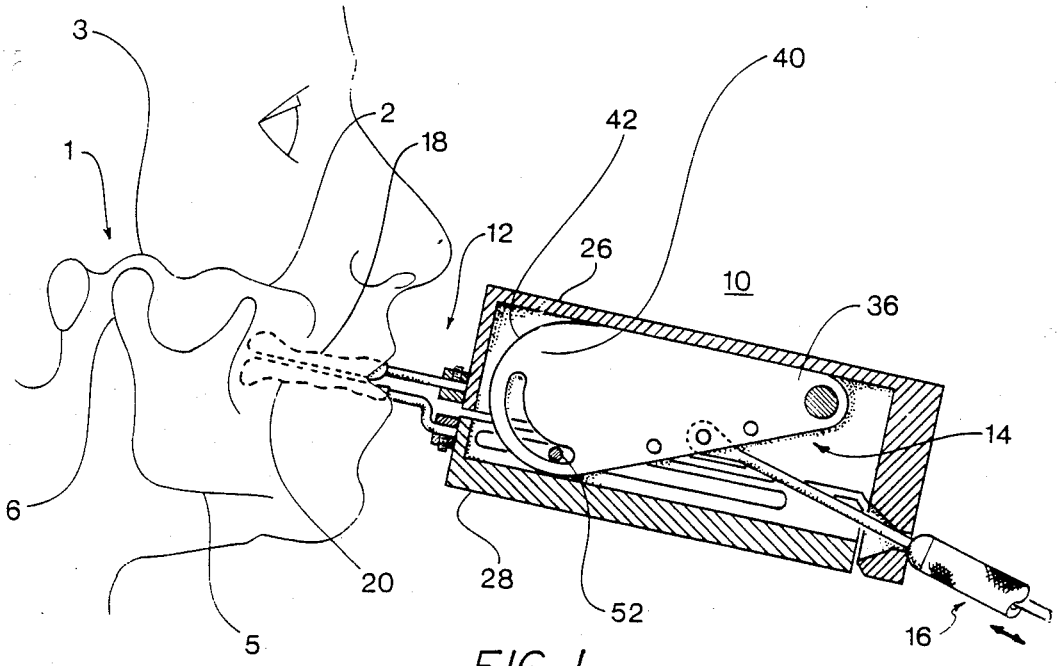
FIG. 1 is a side schematic view in elevation of an oral cavity showing the right TMJ and the novel cam oscillator system coupled to the upper and lower jaws showing the lower jaw in its closed position.

With reference to the schematic drawings, TMJ 1 includes temporal bone 2 which forms glenoid fossa 3 and maxillary or upper jaw 4. Temporomandibular bone 5 forms condyle 6 and lower jaw 7. There is a left TMJ and a right TMJ. Both move simultaneously when they are functionally intact. Functional integrity is related to the synchronism of the TMJ movements themselves, as well as to their interaction with surrounding tissue and muscular structures.

The unique feature of TMJ 1 is its unusual combination of a sliding movement and a hinge movement. A normal TMJ 1 is a finely balanced hinge between fossa 3 and condylar head 6 with a high degree of anatomical precision.

The mandible cam oscillator system 10 of this invention comprises an intraoral-extraoral appliance 12, a driven cam mechanism 14, and a driver 16 for oscillating cam mechanism 14.

Appliance 12 includes a maxillary splint 18 adapted to be releasably secured to upper jaw 4 and/or its teeth, and a mandibular splint 20 adapted to be releasably secured to lower jaw 7 and/or its teeth.

Each splint is constructed of a plastic that resiliently conforms to the patient's teeth and arches. The splints' resiliency allows them to snap on over their mating and assigned jaws, so that they can be quickly, easily and releasably secured to the user's teeth.

Splints 18 and 20 have maxillary and mandibular arms 22 and 24, respectively. Maxillary arm 22 is straight and mandibular arm 24 is Z-shaped. Both arms 22,24 are vertically spaced apart and extend externally from the mouth so as to coincide approximately with the midline of the face.

Arms 22,24 are detachably coupled to upper and lower maxillary and mandibular cam brackets 26,28, respectively. A bushing 30 on each bracket accepts its assigned arm which is fixedly retained therein by a screw 32. Thus, splints 18 and 20 can be quickly and easily attached to the maxillary and mandibular arches on one hand, and to cam brackets 26,28 on the other hand.

A pear-shaped cam member 34 has its top end 36 pivotally mounted about a stub shaft 38 supported by a vertical side wall 41 on upper bracket 26. Lower end 40 of cam 34 has an outer convex articulating surface 42, which rides on a flat shoulder 44 of lower bracket 28, and an arcuate slot 46 near articulating surface 42.

A vertical side wall 48 of lower bracket 28 has a longitudinal straight slot 50. A pin 52 extends through cam 34, lower bracket 28, and slots 46 and 50.

Driver 16 includes a push-pull drive shaft 54, which may have a surrounding sleeve 56. Shaft 54 is pulled and pushed by an electric motor, not shown. Such an arrangement can be similar to that described in said U.S. Pat. No. 4,700,695.

A pivot 58 extends through an enlarged end 64 of shaft 54 and through one of several holes 60 near lateral edge 62 of cam 34, depending on the desired length of the pivot arm offered by cam 34.

In operation, shaft 54 linearly reciprocates back-and-forth at a frequency F between a start position and an end position within a selected range having a displacement D and an average velocity V, thereby forcibly oscillating lower jaw 7 of the user within a predetermined angular range, between a start or closed mouth position and an end or open mouth position, whereby, during one-half cycle of oscillation, lower jaw 7 is forced to move away from upper jaw 4 and, during the other half-cycle, lower jaw 7 is forced to move toward upper jaw 4.

More specifically, while upper end 36 of cam 34 pivots about shaft 38 and lower edge 42 of cam 34 rides on shoulder 44, pin 52 rides within slot 46.

Figure 2:
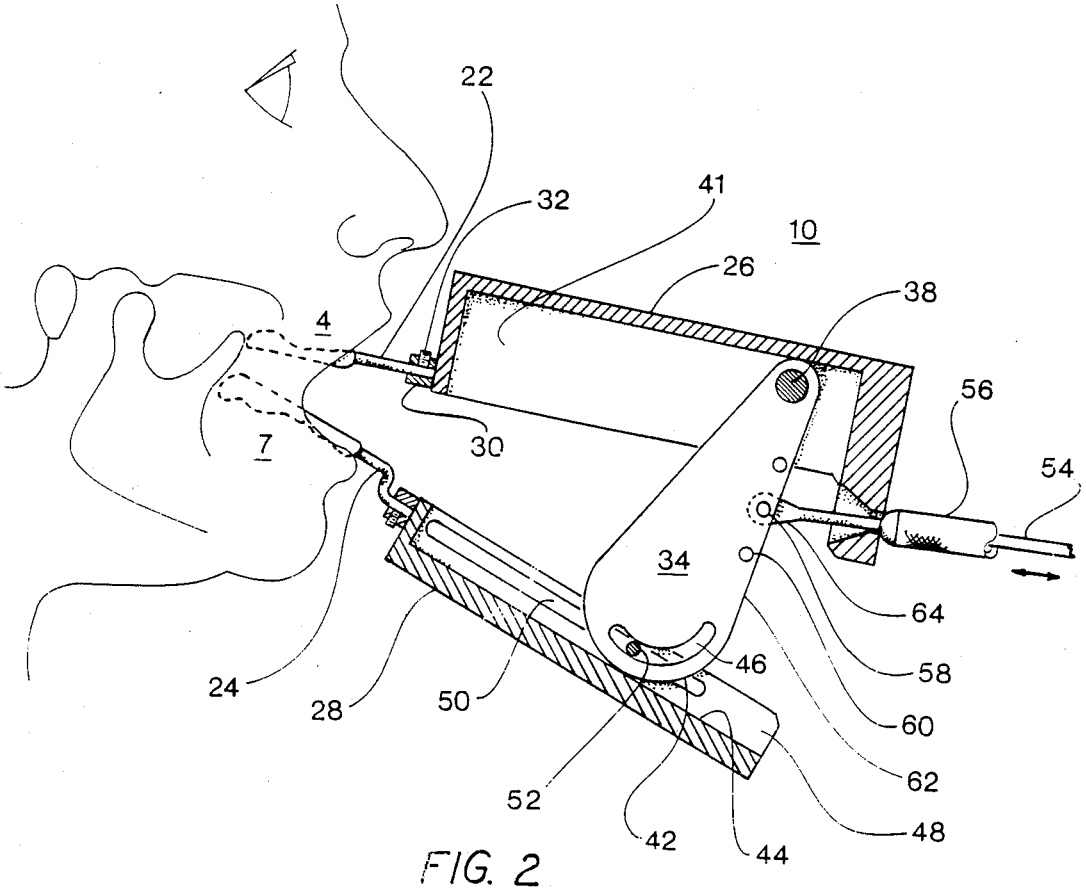
FIG. 2 is a side schematic view in elevation of the system shown in FIG. 1 showing the lower jaw in its open position.

FIG. 1 shows pin 52 near one end of arcuate slot 46, and FIG. 2 shows pin 52 near the opposite end of arcuate slot 46.

Mandibular bracket 28, and hence arm 24 coupled thereto, are made to pivot by cam 34, first downwardly (FIG. 2) and then upwardly (FIG. 1), relative to maxillary bracket 26 by push-pull shaft 54 which moves linearly in opposite longitudinal directions as indicated by the arrows.

Thus, mandibular and maxillary arms 22,24 serve to apply forces through splints 18,20 to the teeth and to the periodontium of the user.

Cam 34 and pin 52 serve to lift up lower jaw 7 during one-half cycle and push lower jaw 7 down away from upper jaw 4 during the other half-cycle of operation.

It will be appreciated that extraoral cam-operated jaw oscillator system 10 can be quickly and easily attached to the maxillary and mandibular arches, and that system 10 does not require critical positioning, aligning and adjusting by an attendant in order to achieve proper bilateral jaw action.

The mandible cam oscillator system 10 is designed to exert relatively small forces against extraoral arms 22,24 during each half-cycle of oscillation. Because there are no intraoral moving parts, there is no possibility for intraoral tissue irritation from the moving parts relative to the contacting tissues.

Oscillator system 10 forcefully imposes on the user rhythmic mandibular movements designed to enhance healing and diminish or eliminate pain and swelling. These movements are unassisted by the user, i.e., he or she does not voluntarily assist or resist them.

By locating cam 34 extraorally allows the user to mount or dismount the hardware extraorally. The user can administer to himself a prescribed continuous or intermittent motion protocol, in his home as well as in the hospital, thus avoiding dependence on an attendant for compliance with his prescribed regimen.

Proper jaw opening and closing is achieved because of the symmetry of operation relative to a plane of symmetry containing the midlines of the arches.

Following the prescribed regimen, the user will enhance healing and rehabilitation of the oral cavity and the TMJ. The user can expect decreased pain resulting in clinically acceptable ranges of mandibular movements.

WHAT I CLAIM IS:

1. In a fully-involuntary mandible oscillator system adapted to forcefully impose on the use rhythmic mandibular movements, an upper splint having a first portion adapted to be releasably secured to the user's upper jaw and having a second portion which extends extraorally, and a lower splint having a third portion adapted to be releasably secured to the user's lower jaw and having a fourth portion which extends extraorally; said system comprising:

an appliance coupled to said second and fourth portions; and extraoral, cam-operated oscillating means coupled to said appliance for forcibly oscillating the lower jaw within a predetermined angular range between a start position and an end position, whereby during one-half cycle of oscillation the lower jaw is forced to move away from the upper jaw, and during the other half-cycle the lower jaw is forced to move toward the upper jaw.

2. In a fully-involuntary mandible oscillator system adapted to forcefully impose on the user rhythmic mandibular movements, an upper splint having a first portion adapted to be releasably secured to the user's upper jaw and having a second portion which extends extraorally, and a lower splint having a third portion adapted to be releasably secured to the user's lower jaw and having a fourth portion which extends extraorally; said system comprising:

bracket means coupled to said second and fourth portions; and cam means coupled between said bracket means for forcibly oscillating the lower jaw within a predetermined angular range between a start position and an end position, whereby during one-half cycle of oscillation the lower jaw is forced to move away from the upper jaw, and during the other half-cycle the lower jaw is forced to move toward the upper jaw.

3. The mandible oscillator system according to claim 2, wherein said bracket means include an upper bracket releasably secured to said second portion; and a lower bracket releasably secured to said fourth portion.

4. The mandible oscillator system according to claim 3, wherein said cam means is pivotally coupled to said upper bracket; and reciprocating linear means for pivoting said cam means.

* * * * *